US009126441B1

(12) United States Patent
Toriihara et al.

(10) Patent No.: US 9,126,441 B1
(45) Date of Patent: Sep. 8, 2015

(54) SHEET CONVEYANCE APPARATUS, SHEET CUTTING APPARATUS, AND IMAGE FORMING APPARATUS

(71) Applicant: CANON KABUSHIKI KAISHA, Tokyo (JP)

(72) Inventors: Shigeru Toriihara, Kawasaki (JP); Masahito Yoshida, Shiki (JP); Masahiro Sugimoto, Yokohama (JP); Seiji Suzuki, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/627,183

(22) Filed: Feb. 20, 2015

(30) Foreign Application Priority Data

Feb. 28, 2014 (JP) ..... 2014-039576

(51) Int. Cl.

| | |
|---|---|
| ***B41J 11/70*** | (2006.01) |
| ***B26D 7/00*** | (2006.01) |
| ***B26D 7/32*** | (2006.01) |
| ***B26D 7/18*** | (2006.01) |

(52) U.S. Cl.
CPC . *B41J 11/70* (2013.01); *B26D 7/32* (2013.01); *B26D 7/18* (2013.01)

(58) Field of Classification Search
USPC ..... 400/621; 346/24
See application file for complete search history.

(56) References Cited

U.S. PATENT DOCUMENTS

| | | | | |
|---|---|---|---|---|
| 5,921,690 | A | 7/1999 | Shinmachi et al. | |
| 6,027,269 | A | 2/2000 | Yoshida | |
| 6,260,457 | B1 * | 7/2001 | Hakkaku | 83/167 |
| 6,415,130 | B1 | 7/2002 | Fujiwara et al. | |
| 8,783,859 | B2 | 7/2014 | Tokisawa et al. | |
| 8,911,167 | B2 * | 12/2014 | Kanazawa et al. | 400/621 |
| 2008/0111299 | A1 * | 5/2008 | Sato | 271/278 |
| 2014/0234001 | A1 | 8/2014 | Fuse et al. | |
| 2014/0239580 | A1 | 8/2014 | Yoshida et al. | |

FOREIGN PATENT DOCUMENTS

JP 2013-086249 A 5/2013

* cited by examiner

*Primary Examiner* — Huan Tran
(74) *Attorney, Agent, or Firm* — Fitzpatrick, Cella, Harper & Scinto

(57) ABSTRACT

A sheet conveyance apparatus including a conveyance unit configured to convey a sheet, wherein the conveyance unit includes a slanting surface having an inclination with respect to a horizontal surface and a conveyance surface that forms, together with the slanting surface, a space that becomes narrower downward in the vertical direction and which moves in a predetermined direction, and conveys the sheet in a predetermined direction by the movement of the conveyance surface.

15 Claims, 9 Drawing Sheets

SHEET CONVEYANCE APPARATUS, SHEET CUTTING APPARATUS, AND IMAGE FORMING APPARATUS

BACKGROUND OF THE INVENTION

1. Field of the Invention

The present invention relates to a sheet conveyance apparatus, a sheet cutting apparatus, and an image forming apparatus including a sheet conveyance unit configured to convey a cut sheet.

2. Description of the Related Art

An image forming apparatus, such as a printer, that forms an image on a sheet based on predetermined information is known conventionally. There is known a configuration incorporating a sheet cutting unit or mounting a sheet cutting apparatus in order to obtain a product having a desired size or to remove an unwanted portion, such as a margin between images in continuous image formation, in the case where an image is formed on a long sheet, such as roll paper.

Unwanted sheet pieces that have been cut by a sheet cutting unit or a sheet cutting apparatus (hereinafter, also referred to as a cutter unit) are accumulated temporarily in a trash box and are disposed of after the trash box becomes full. However, depending on the configuration of a cutter unit or on whether or not usability has been taken into consideration, the arrangement of a trash box for accumulating unwanted sheet pieces is limited. Even in the case where a trash box cannot be arranged in a position, which is a destination of unwanted cut sheet pieces that fall freely, it is required for unwanted sheet pieces to be discharged securely into a trash box.

In order to address this problem, Japanese Patent Laid-Open No. 2013-86249 has proposed a cutter unit and a sheet conveyance unit configured to convey unwanted cut sheet pieces as shown in FIG. 8. A long sheet on which an image is formed and which is conveyed in a direction indicated by an arrow A in FIG. 8 (hereinafter, also referred to as a conveyance direction A) is cut by a cutter including elements 801, 802, 803, 805, and 806 in the cutter unit and unwanted sheet pieces (hereinafter, also referred to as cut trash) are cut off. Cut trash T falls freely on a conveyance belt 811. After the cut trash T becomes stationary in a prone position in which the side with a large area of the cut trash T (usually, the surface or backside of the sheet) faces the top surface of the conveyance belt 811, the drive of the conveyance belt 811 is started and the cut trash T is conveyed in a conveyance direction C. After that, the cut trash T is discharged into a trash box 812 by being pinched and conveyed by a pinch and conveyance system including the conveyance belt 811 and a driven belt 813 facing the conveyance belt 811. In this way, even in the case where a trash box cannot be arranged in a position, which is the destination of the cut trash T that falls freely, the cut trash T is discharged into a trash box.

SUMMARY OF THE INVENTION

However, there are a variety of lengths, widths, thicknesses, shapes of curl, etc., of the cut trash T depending on requests of users and specifications of an image forming apparatus and sheets. Among others, there can be a situation where the width of the cut trash T is great and the sheet is curling in the thickness direction. In such a situation, there is often a possibility that the cut trash T will be erected on the conveyance belt 811 with the cut side whose area is small or the opposite side facing the surface of the conveyance belt 811. There is a possibility that the cut trash T that has once been erected will rest in the erected position and will not fall into a prone position even in the case where a long period of time elapses in waiting for the drive of the conveyance belt 811. There is a possibility that the cut trash T in the erected position cannot thrust into the pinch part of the pinch and conveyance system (the conveyance belt 811 and the driven belt 813) of Japanese Patent Laid-Open No. 2013-86249, and therefore, is not pinched and conveyed. Even in the case where the cut trash T can thrust thereinto, it is pinched in an undesirable position, and therefore, there is a possibility that the drive load of the pinch and conveyance system becomes too heavy and the conveyance belt 811 can no longer be driven. As a result, there is a possibility that the cut trash T is not discharged from the top of the conveyance belt 811 into the trash box 812.

Consequently, an object of the present invention that has been made based on the recognition of the above-described problems is to provide a sheet conveyance apparatus, a sheet cutting apparatus, and an image forming apparatus including a sheet conveyance unit capable of securely discharging cut trash produced at the time of cutting into a trash box.

The sheet conveyance apparatus of the present invention for achieving the above-described object is a sheet conveyance apparatus including a conveyance unit configured to convey a sheet, wherein the conveyance unit includes a slanting surface having an inclination with respect to a horizontal surface, and a conveyance surface that forms, together with the slanting surface, a space that becomes narrower downward in the vertical direction and which moves in a predetermined direction, and conveys the sheet in a predetermined direction by the movement of the conveyance surface.

According to the sheet conveyance apparatus, the sheet cutting apparatus, and the image forming apparatus including a sheet conveyance unit configured to convey a sheet based on the present invention, it is possible to convey a medium in the form of a cut sheet stably and securely. Consequently, it is possible to provide a printer that can stably and securely discharge cut trash produced at the time of cutting into a trash box, in which cut trash is not jammed, and which has high productivity.

Further features of the present invention will become apparent from the following description of exemplary embodiments (with reference to the attached drawings)

DESCRIPTION OF THE EMBODIMENTS

First Embodiment

Hereinafter, an ink jet printer is explained in detail as an embodiment of an image forming apparatus according to the present invention.

A printer of the present embodiment is a high-speed line printer capable of performing one-side printing and both-side printing on a long sheet, such as a continuous sheet wound into the form of a roll. Such a high-speed printer is suitable to printing of a large number of sheets, for example, in a printing laboratory. On the other hand, it is also possible to apply the present invention to various kinds of image forming apparatuses other than the high-speed printer, such as a multifunction peripheral, a copying machine, and a facsimile machine. Further, it is also possible to apply the present invention widely to various kinds of apparatuses that convey and perform processing on a medium, not limited to image forming apparatuses. The following description of the embodiment does not limit the application range of the present invention.

Figure 1:
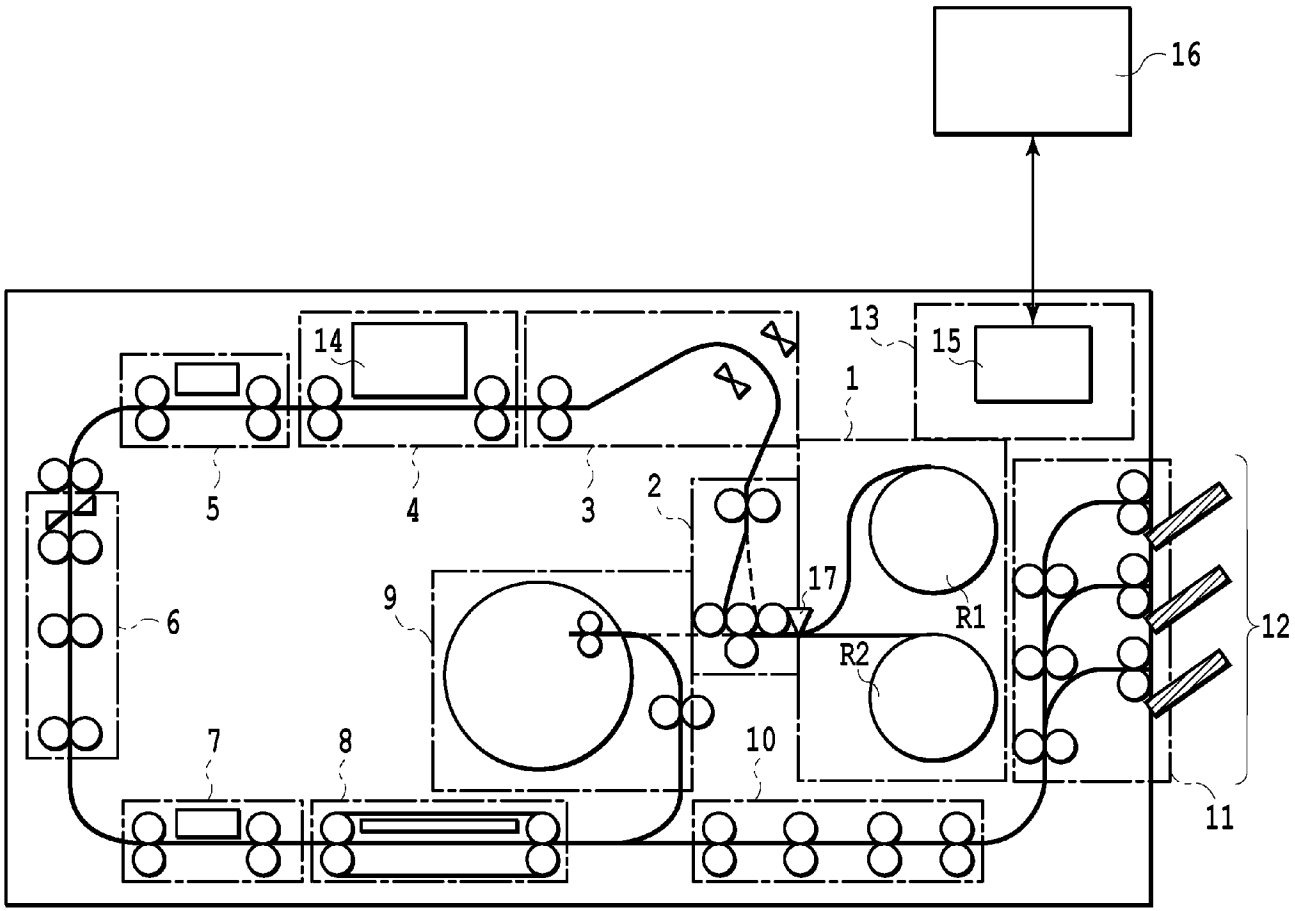
FIG. 1 is a schematic diagram showing a configuration of a printer according to an embodiment of the present invention.

FIG. 1 is schematic diagram showing a unit configuration of a printer of the present embodiment. This printer includes a sheet feed unit 1, a de-curl unit 2, an oblique travel correction unit 3, a printing unit 4, an inspection unit 5, a cutter unit 6, an information printing unit 7, a drying unit 8, a reversal unit 9, a discharge and conveyance unit 10, a sorter unit 11, a discharge unit 12, and a controller 13.

The sheet feet unit 1 is a unit configured to hold and feed a sheet R in the form of a continuous sheet wound into the form of a roll. The sheet feed unit 1 houses a sheet R1 and a sheet R2 and feeds them selectively. The number of sheet rolls that can be housed is not limited to two and the number may be one or three or more. The sheet R is conveyed by a conveyance mechanism, such as a roller pair and a belt, along a conveyance path indicated by the solid line in FIG. 1. In each unit, the sheet R is subjected to predetermined processing.

The de-curl unit 2 is a unit configured to reduce a curl of a sheet fed by the sheet feed unit 1. The de-curl unit 2 has a pinch and conveyance system including one drive roller and two pinch rollers and conveys a sheet while giving a warp in the opposite direction of the curl. The sheet will deform plastically and thus the curl is reduced.

The oblique travel correction unit 3 is a unit configured to correct the oblique travel of a sheet that has passed through the de-curl unit 2. By pressing the sheet end part to a guide member, the oblique travel of the sheet is corrected. After the oblique travel is corrected, there occurs a mismatch in the conveyance direction between the de-curl unit 2 and the printing unit 4. The mismatch occurs as a twist of the sheet. In order to accept a twist, the oblique travel correction unit 3 has a loop part in the conveyance path on the side of the de-curl unit 2. At the loop part, the sheet may deform elastically without receiving restriction by a supporting member. At the same time, the loop part has functions, such as a function to eliminate a mismatch in speed between units on the upstream and downstream sides in the sheet conveyance direction and a function to separate a tension that propagates the sheet.

The printing unit 4 is a unit configured to print an image on a sheet. The printing unit 4 includes a print head 14 that ejects ink and a plurality of drive rollers for conveying a sheet. The ink ejected from the print head 4 sticks to a sheet. By controlling the ejection of ink and the conveyance of a sheet in a meticulous manner, the group of inks sticks to desired positions on the sheet and thus an image is formed on the sheet. The print head 14 has a line-type print head in which a row of ink jet nozzles is formed in a range exceeding the specified sheet width. In the print head 14, a plurality of print heads is put side by side along the conveyance direction. In the present embodiment, the print head 14 has seven print heads corresponding to seven colors, i.e., C (Cyan), M (Magenta), Y (Yellow), LC (Light Cyan), LM (Light Magenta), G (Gray), and K (Black). The number of colors and the number of print heads are not limited to seven. The ink jet system is not limited in particular and the energy generation element for ejecting ink may be a heat producing element, a piezo element, an electrostatic element, and a MEMS element, and the kind thereof is not limited in particular. Inks are supplied to the print head 14 from ink tanks via ink tubes.

The inspection unit 5 is a unit configured to inspect and determine the state of the printer and the quality of an image printed on a sheet. An inspection pattern or an image printed on a sheet by the printing unit 4 is read by a scanner. Based on this, the inspection unit 5 inspects the state of the print head nozzles and the conveyance state of the sheet, and determines whether a desirable image has been printed in a desirable position of the sheet. The image sensor that is mounted on the scanner may be an image sensor that uses a device, such a CCD (Charge-Coupled Device) and a CMOS (Complementary Metal Oxide Semiconductor), and the kind of the device is not limited.

The cutter unit 6 is a unit configured to cut a printed sheet into a predetermined length. In the printer of the present embodiment, the function of the cutter unit 6 in printing in the one-side printing and in printing of the backside in the both-side printing mode is different from that in printing of the surface in the both-side printing mode. In printing in the one-side printing mode and in printing of the backside in the both-side printing mode, the cutter unit 6 cuts a printed sheet into small pieces, for example, for each image, and conveys the pieces to the information printing unit 7, to be described later. Details of the cutting operation of the cutter unit 6 will be described later. In printing of the surface in the both-side printing mode, the cutter unit 6 sends a sheet in the stage where only printing of the surface has been completed but printing of the backside is not performed to the information printing unit 7 without cutting the sheet into small pieces and causes the reversal unit 9, to be described later, to wind up the sheet. In the case where the sheet runs short, or where the image data runs short, or where the length of the wound sheet of the reversal unit 9 reaches an upper limit, etc., the cutter unit 6 cuts the sheet. The reversal unit 9 winds up the sheet until the rear end (cut end) of the sheet formed by the cutter unit 6 is wound up.

The information printing unit 7 is a unit configured to print information, such as a serial number and the date of printing, in a non-printed area of the cut sheet. Printing is performed by printing characters or codes in the inkjet system or in the thermal transfer system. On the upstream side of the information printing unit 7 in the sheet conveyance direction and on the downstream side of the cutter unit 6, a sensor 23 configured to detect the front end edge of the cut sheet is provided. The sensor 23 detects the end parts of the sheet between the cutter unit 6 and the printing position by the information printing unit 7. Based on the detection timing of the sensor 23, the timing at which information is printed by the information printing unit 7 is controlled.

The drying unit 8 is a unit configured to promote the fixing of the ink that has stuck to the sheet. For example, by supplying a hot wind to the printed side of a sheet on which an image has been printed or by irradiating the printed side with infrared light, the temperature of the sheet is raised and thus the ink is dried. In the case where the ink is an ultraviolet curable ink, the sheet is irradiated with ultraviolet light.

The sheet conveyance path from the sheet feed unit 1 up to the drying unit 8 explained above is referred to as a first path. In the first path, each unit of the printing unit 4 up to the drying unit 8 is arranged so as to form a shape in which the sheet conveyance path U-turns. In this printer, the advance direction of a sheet that is conveyed in the sheet conveyance path before the cutter unit 6 is opposite to that in the sheet conveyance path after the cutter unit 6 with the cutter unit 6 as a boarder.

The reversal unit 9 is a unit configured to temporarily house a sheet between the printing of the surface and the printing of the backside at the time of performing printing in the both-side printing mode. Here, the path from the drying unit 8 up to the printing unit 4 through the de-curl unit 2 is referred to as a second path. The reversal unit 9 is installed on the way of the second path. The reversal unit 9 includes a drum for winding up the sheet. The sheet for which the printing of the surface has been completed is wound up by the drum until the rear end is wound up. After that, the drum rotates in the opposite direction and the sheet is fed to the de-curl unit and the printing unit 4 from the rear end. At this time, the surface and the backside of the sheet are reversed and the printing of the backside is performed on the sheet having reached the printing unit 4 again.

The discharge and conveyance unit 10 is a unit configured to deliver the sheet that has been cut in the cutter unit 6 and dried in the drying unit 8 to the sorter unit 11. Here, the path from the drying unit 8 up to the discharge unit 12 through under the sheet feed unit 1 is referred to as a third path. The sheet that has been conveyed in the first path is guided to either the second path or the third path. For such guiding, a path switch mechanism having a movable flapper is installed between the drying unit 8 and the discharge and conveyance unit 10.

The sorter unit 11 a unit configured to sort printed sheets into significant groups. The sorted sheets are discharged to the discharge unit 12 including a plurality of trays.

The controller 13 is a unit configured to control each piece of hardware of the printer. The controller 13 includes a CPU (Central Processing Unit), a storage device, an I/O device, etc. The printer is controlled based on commands of the controller 13 or a host device 16 that is connected to the controller 13 via an I/F.

Figure 2:
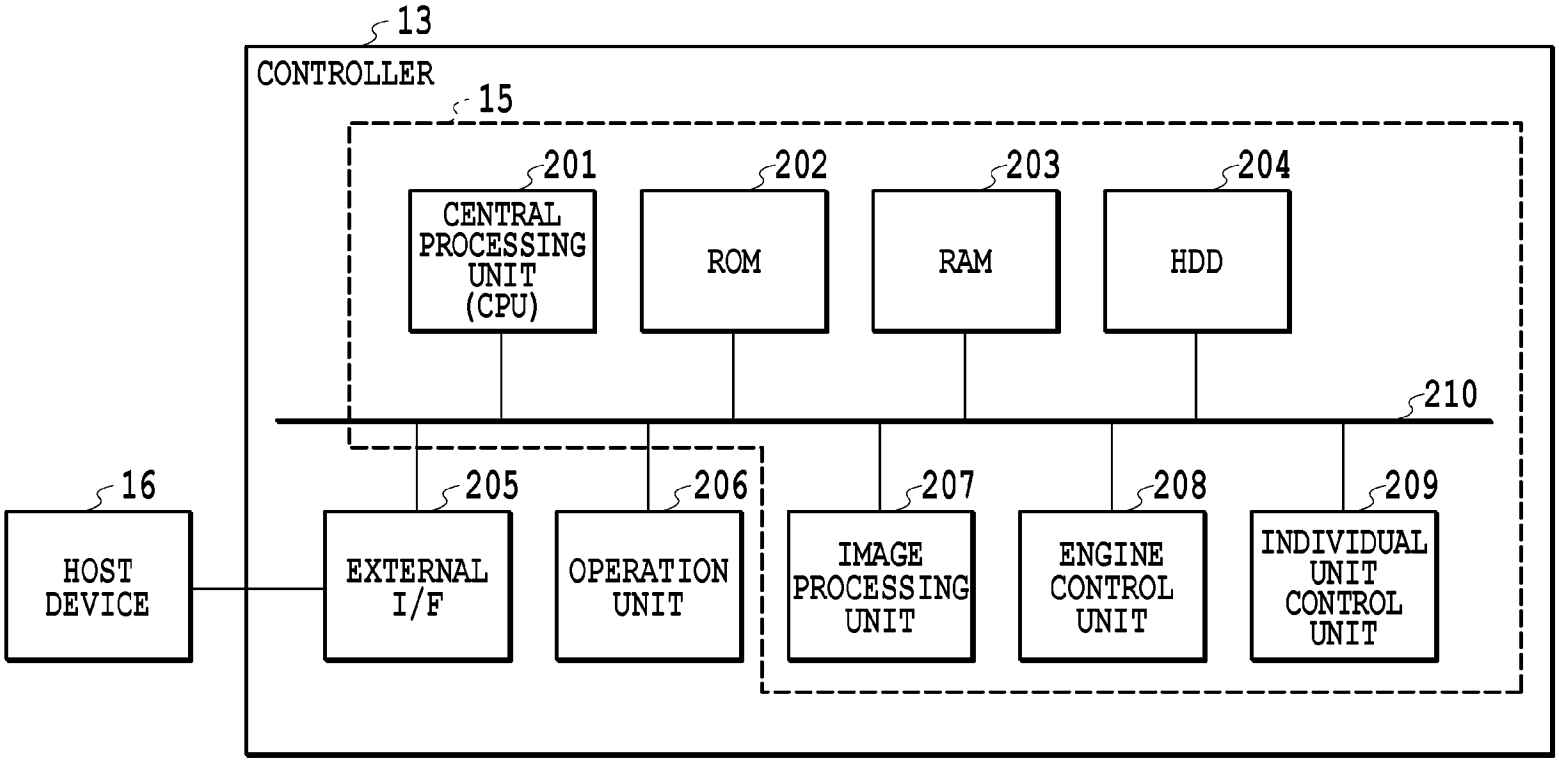
FIG. 2 is a block diagram showing a control unit of the printer according to the embodiment of the present invention.

FIG. 2 is a block diagram showing a concept of the controller 13. A CPU 201 executes programs and performs an arithmetic operation. A ROM 202 stores programs that are executed by the CPU 201 and parameters. A RAM 203 is used as a work area of the CPU 201 and temporarily stores parameters. An HDD 204 stores programs that have a comparatively large capacity and which are executed by the CPU 201, print data, and parameters. An operation unit 206 is an input/output interface through which a user performs inputting/outputting and which includes a keyboard, a mouse, a display, and a speaker. In the present embodiment, a display with a touch panel function is installed.

The controller 13 includes an arithmetic operation processing unit whose functions have been specialized, besides the CPU 201.

An image processing unit 207 performs processing on print data that is dealt with by the printer. The image processing unit 207 performs conversion of input image data from a color space (e.g., YCbCr) into the standard RGB color space (e.g., sRGB), resolution conversion, analysis, correction, etc., in accordance with necessity. The print data on which processing has been performed is stored in the RAM 203 or the HDD 204.

An engine control unit 208 performs control of the drive of the print head 14 of the printing unit 4 based on the print data. Further, the engine control unit 208 also performs control of each piece of hardware of the printer.

An individual unit controller 209 is a sub controller that is installed in each of the sheet feed unit 1, the de-curl unit 2, the oblique travel correction unit 3, the inspection unit 5, the cutter unit 6, the information printing unit 7, the drying unit 8, the reversal unit 9, the discharge and conveyance unit 10, the sorter unit 11, and the discharge unit 12. Some control is completed by the sub controller, and therefore, the load of the CPU 201 is reduced. The controller 13 is connected to the host device 16 via an external interface (I/F) 205. The external interface (I/F) 205 may be a local I/F or a network I/F.

The host device 16 supplies print data to the controller 13. The host device 16 may be a device, such as a general-purpose or dedicated computer, an image capturer having an image reader unit, a digital camera, and a photo storage. In the case where the host device 16 is a computer, an OS (operating system), application software for generating image data, and a printer driver are installed in a storage device included in the computer. It is not indispensable to implement all the pieces of processing described above by using software, and it may also be possible to implement part of or all the pieces of processing by using hardware.

Figure 3A:
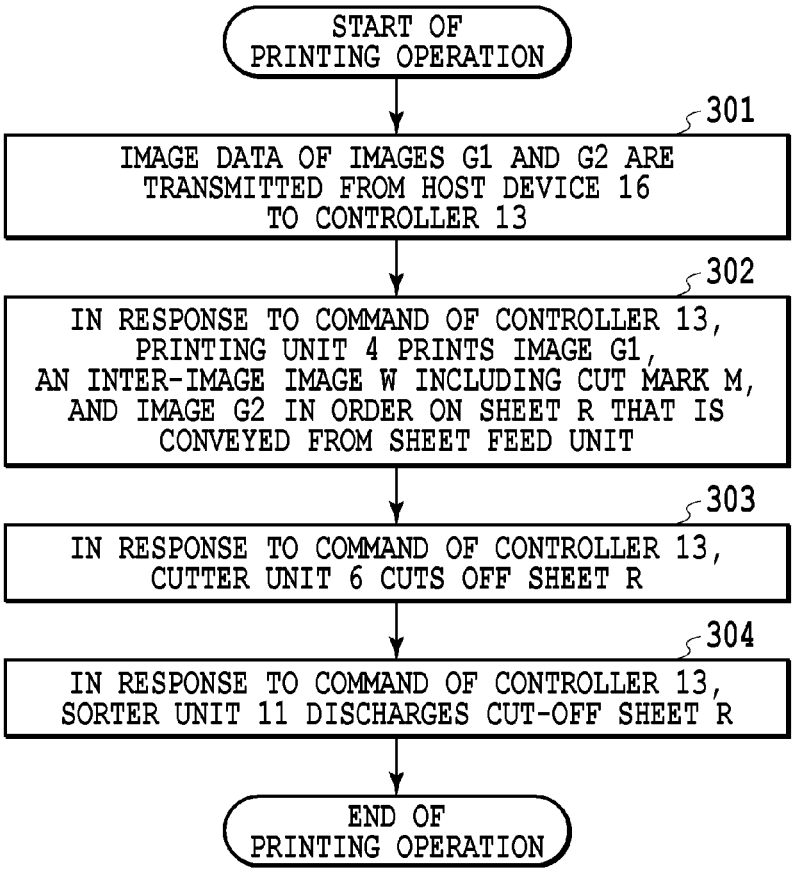
FIG. 3A is a flowchart explaining a print sequence according to the embodiment of the present invention.
Figure 3B:
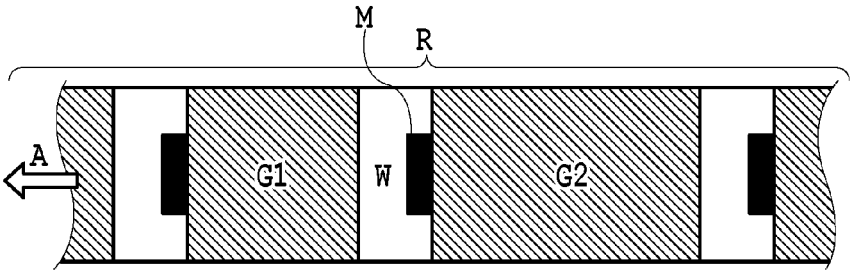
FIG. 3B is a top view explaining the print sequence according to the embodiment of the present invention.

By using FIG. 3A and FIG. 3B, a sequence in the case where the printer of the present embodiment performs a printing operation is explained in detail. First, as shown in a sequence 301 in FIG. 3A, image data of images G1 and G2 is transmitted from the host device 16 to the controller 13. Next, as shown in a sequence 302, in response to a command of the controller 13, the printing unit 4 prints the image G1, an image W including a cut mark M, and the image G2 in order on the surface of the sheet R conveyed from the sheet feed unit 1 as shown in FIG. 3B. At this time, the sheet R is conveyed toward the conveyance direction A in FIG. 3B. Following this, as shown in a sequence 303, in response to a command of the controller 13, the cutter unit 6 cuts off the sheet R. Finally, as shown in a sequence 304, in response to a command of the controller 13, the sorter unit 11 discharges the cut-off sheets R in order.

Figure 4:
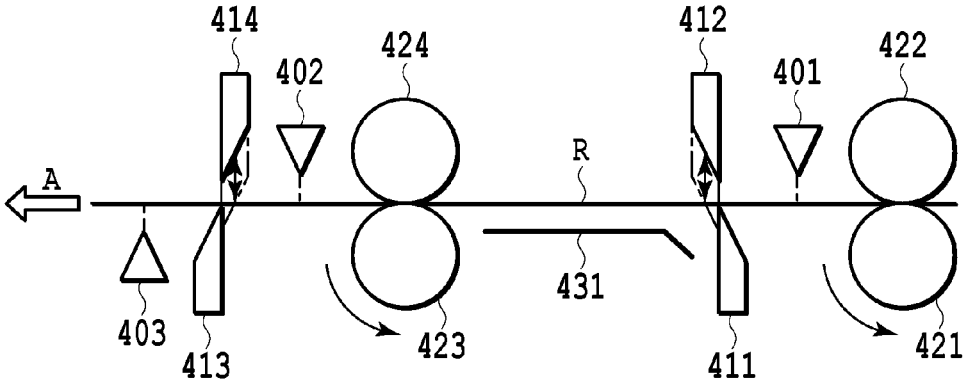
FIG. 4 is a schematic side view of a cutter unit according to the embodiment of the present invention.

The configuration of the cutter unit 6 of the printer of the present embodiment is explained in more detail. FIG. 4 is a side view of a configuration including only the extracted portion related to the cutting operation of the cutter unit 6. The partial configuration of the cutter unit 6 is explained from the upstream side in the conveyance direction A. First, a first conveyance roller 421 and a first pinch roller 422 for pinching and conveying the sheet Rare arranged. On the downstream side thereof, a first cut mark sensor 401 configured to detect a cut mark printed on the sheet R, a first cutter fixed blade 411 and a first cutter movable blade 412 for performing first cutting for the sheet R, and a guide plate 431 for guiding the front end of the sheet R are arranged in order. Then, on the downstream side thereof, a second conveyance roller 423 and a second pinch roller 424 for pinching and conveying the sheet R are arranged. On the downstream side thereof, a second cut mark sensor 402 configured to detect a cut mark printed on the sheet R, a second cutter fixed blade 413 and a second cutter movable blade 414 for performing second cutting for the sheet R, and an edge sensor 403 configured to detect passing of the front end of the sheet R are arranged.

While the sheet is passing through the partial configuration of the cutter unit 6, the operations, such as the conveyance of the sheet, the detection of a cut mark, the stopping of the conveyance of the sheet, and the cutting of the sheet, are repeated and thereby the sheet is cut off. By the series of operations, cut marks and preliminary patterns between images are cut off and a product of a desired image and/or length is conveyed to the information printing unit 7 located downstream in the conveyance direction A.

By using FIG. 5A to FIG. 5H, the operation of the cutter unit 6 is explained in detail.

Figure 5A:
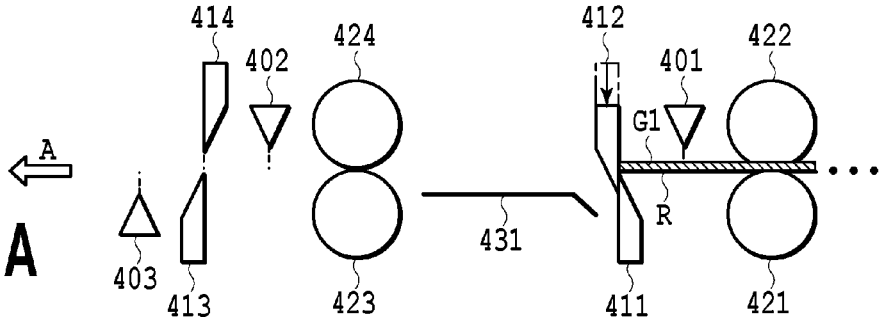
FIGS. 5A to 5H are diagrams showing the operation to cut a sheet by the cutter unit in FIG. 4 in a chronological order.

FIG. 5A is a snapshot at the instant at which the first cutting is performed by the first cutter fixed blade 411 and the first cutter movable blade 412. On the sheet R, the image G1 has already been printed by the printing unit 4 and by the first cutting, the front end of the image G1 is cut. It is assumed that this cutting is not cutting at an erroneous timing or in an erroneous position due to the reliable detection of a cut mark and appropriate timing control. After the first cutting, the controller 13 specifies the amount of conveyance to the first conveyance roller 421 and starts counting up time. In the meantime, the cut mark sensor 401 is disabled, and therefore, the scan operation is not performed on any pattern on the sheet R.

Figure 5B:
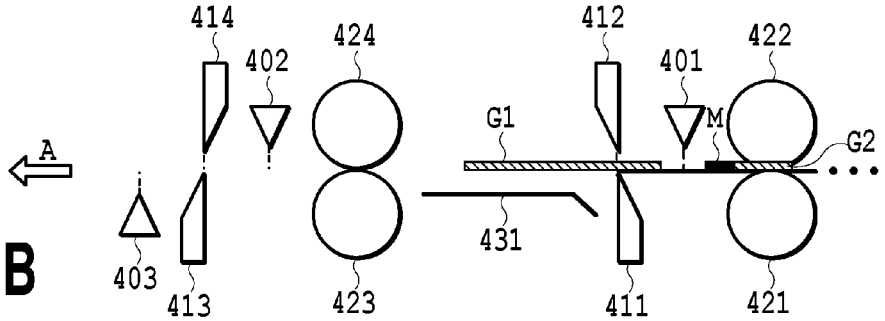

FIG. 5B is a snapshot at the instant at which the count by the controller 13 reaches a default value and the cut mark sensor 401 returns to the effective state. In the case where the upper limit default value of the count and the length of the margin located between the image G1 and the cut mark M are sufficient for the conveyance error, the cut mark sensor 401 returns to the effective state while the margin is passing under the sensor. In the case where there is a margin under the sensor, the erroneous detection of the cut mark sensor 401 or the erroneous cutting following this will not occur.

Figure 5C:
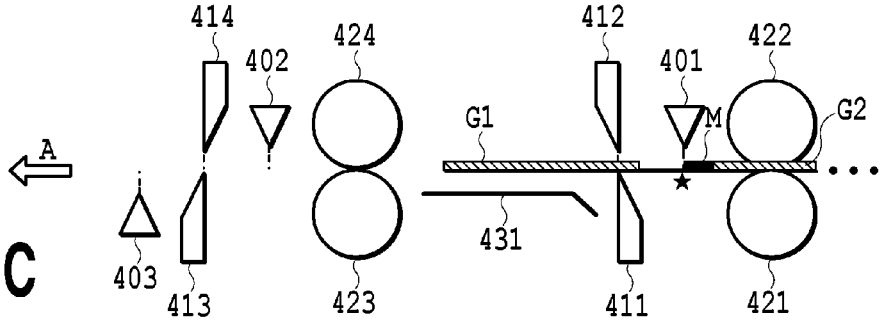

FIG. 5C is a snapshot at the instant at which the cut mark sensor 401 detects the cut mark M. The cut mark sensor 401 detects a switch from the margin to the cut mark M (in the present embodiment, a change in contrast from white to black).

Figure 5D:
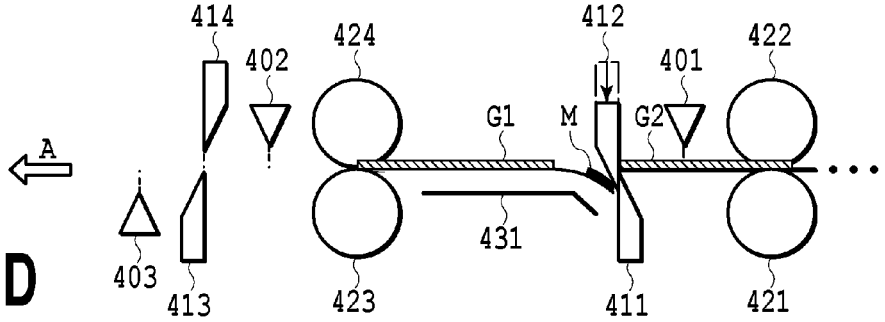

FIG. 5D is a snapshot at the instant at which the rear end of the cut mark M and the front end of the image G2 following the image G1 are cut off by the first cutting again. At the instant of the cutting, the conveyance of the sheet R stops temporarily. The temporary stop of conveyance and the first cutting for the second time that follows are performed after the default counting triggered by the mark detection shown in FIG. 5C.

Figure 5E:
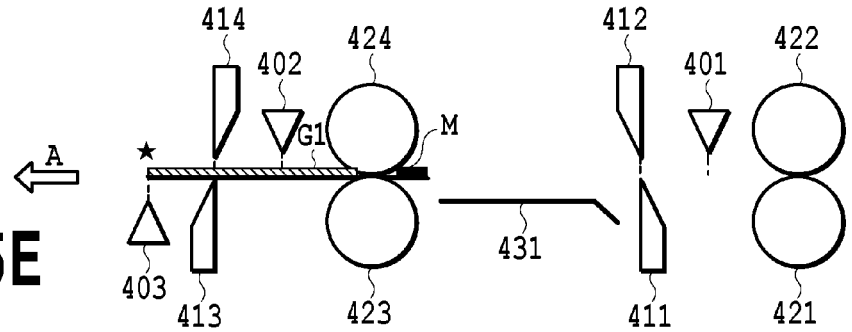

FIG. 5E is a snapshot at the instant at which the edge sensor 403 detects the front end of the sheet R on which the image G1 and the cut mark M including a margin between the image G1 and the cut mark M are printed. After the edge is detected, the controller 13 specifies the amount of conveyance to the second conveyance roller 423 and starts counting up time. At this time, the cut mark sensor 402 is disabled and any pattern on the sheet R is not scanned.

Figure 5F:
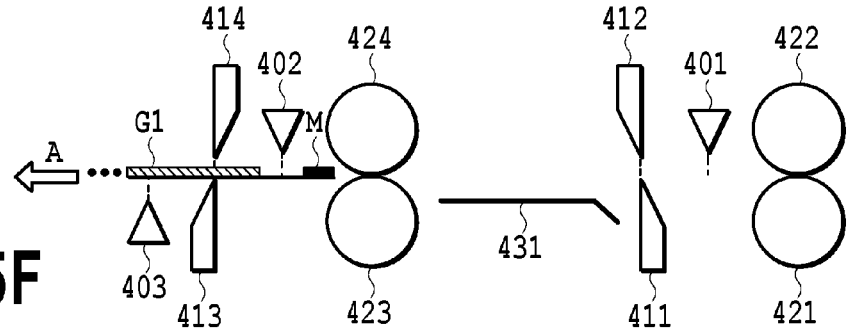

FIG. 5F is a snapshot at the instant at which the count by the controller 13 reaches a default value and the cut mark sensor 402 becomes effective. In the case where the upper limit default value of the count and the length of the margin located between the image G1 and the cut mark M are sufficient for the conveyance error, the cut mark sensor 404 becomes effective while the margin is passing under the sensor. In the case there is a margin under the sensor, the erroneous detection of the cut mark sensor 402 or the erroneous cutting following this will not occur.

Figure 5G:
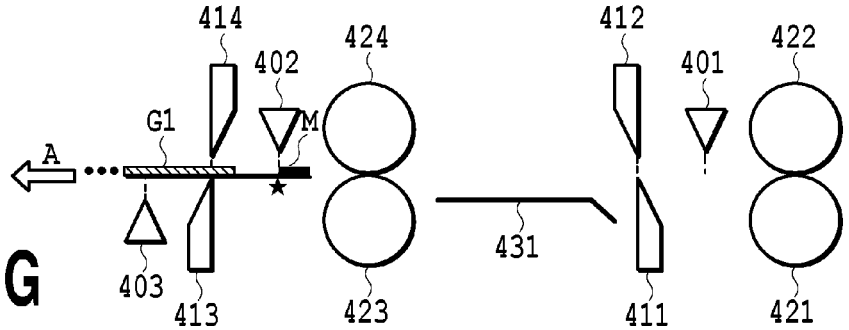

FIG. 5G is a snapshot at the instant at which the cut mark sensor 402 detects the cut mark M. The cut mark sensor 402 detects a switch from the margin to the cut mark M (in the present embodiment, a change in contrast from white to black).

Figure 5H:
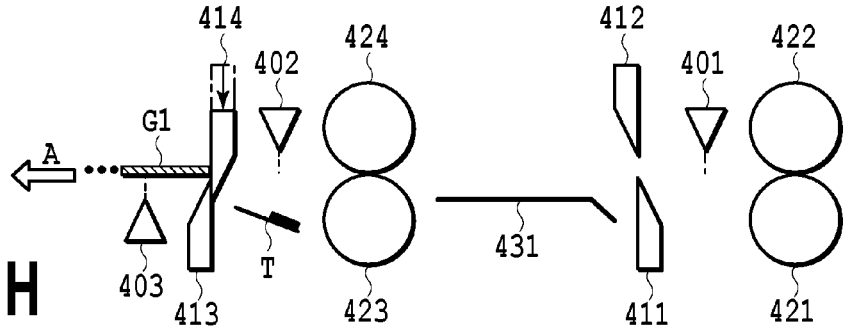

FIG. 5H is a snapshot at the instant at which the image G1, the margin, and the cut mark M are cut off by the second cutting. At this time, the conveyance of the sheet R on which the image G1 is printed is in the temporarily stopped state. The temporary stop of conveyance and the second cutting that follows are performed after the default counting triggered by the mark detection shown in FIG. 5G.

In the position that is the destination of the fall of the cut trash T including the margin and the cut mark M that have been cut off, a cut trash discharge unit is arranged. Only the product on which the image G1 is printed and which has a desired length through the series of cutting operations is conveyed to the information printing unit 7.

Figure 6A:
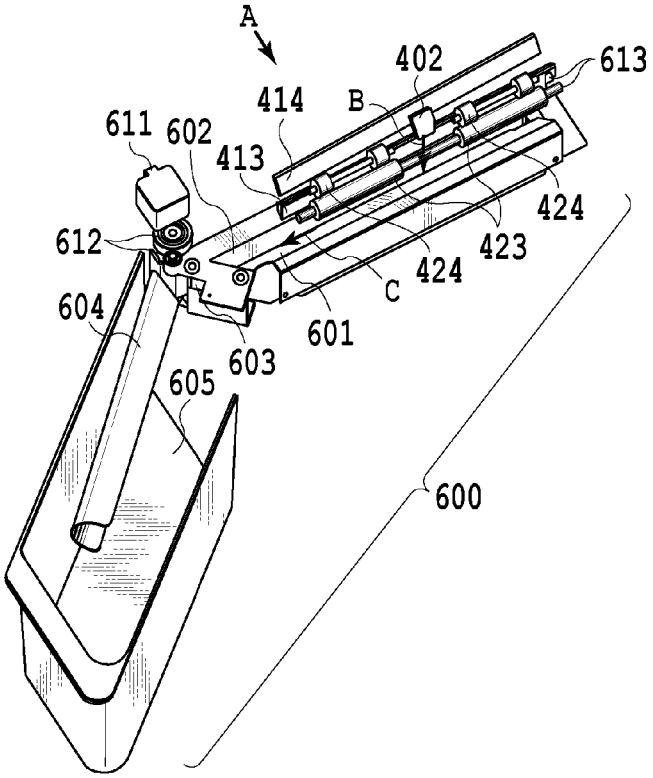
FIG. 6A is a perspective view of a cut trash discharge unit according to the embodiment of the present invention.
Figure 6B:
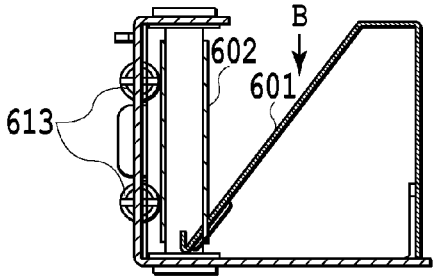
FIGS. 6B and 6C are section diagrams of the cut trash discharge unit according to the embodiment of the present invention.
Figure 6C:
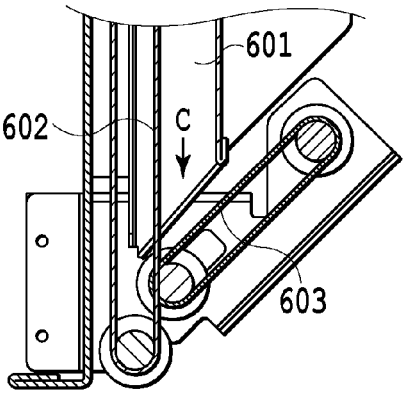

By using FIG. 6A to FIG. 6C, a cut trash discharge unit 600 is explained in detail.

FIG. 6A is a perspective view of the whole of the cut trash discharge unit 600. The cut trash discharge unit 600 includes a slope 601, a belt 602, a pinch belt 603, a guide 604, a trash box 605, a motor 611, a gear train 612, and a belt tensioner 613.

A direction indicated by an arrow B in FIG. 6A is called a fall direction B and a direction indicated by an arrow C is called a belt conveyance direction C. The posture of the cut trash T that has been conveyed in the sheet conveyance direction A by the printer and cut off by the second cutting is not fixed due to the impact of cutting, but generally it falls in the fall direction B. The fallen cut trash T lands on the slope 601.

FIG. 6B is a section diagram in the case where the cut trash discharge unit 600 is viewed from the downstream side in the belt conveyance direction C in the direction opposite to the belt conveyance direction C and the cut trash discharge unit 600 is cut at the portion near the center of the slope 601. The sheet conveyance direction A by the printer, the fall direction B of the cut trash, and the belt conveyance direction C corresponding to the conveyance direction of the cut trash by the belt 602 are directions that intersect with one another. As shown in FIG. 6B, the slope 601 is a slanting surface inclined with respect to a horizontal surface in a degree in which the cut trash T slides down smoothly. The coefficient of friction of the slope 601 is kept low by selecting an appropriate material or surface treatment. The slope 601 is configured so as to be inclined also with respect to the belt 602 and the distance between the slope 601 and the belt 602 becomes greater upward in the vertical direction, i.e., toward the upstream side in the fall direction B, and becomes smaller toward the downstream side in the fall direction B (downward in the vertical direction). Due to this, even the cut trash T whose position and posture are not fixed due to the impact of cutting is guided securely and can invade a space formed by being pinched by the slope 601 and the belt 602. On the other hand, at the lower part in the vertical direction of the slope 601, the slope 601 and the belt 602 are in contact with each other under a slight pressure. The belt 602 is formed by a flexible material, such as rubber, and therefore, at the contact part with the slope 601, the shape of the belt 602 follows the shape of the slope 601. The contact pressure between the slope 601 and the belt 602 is determined by the tension of the belt 602 given by the belt tensioner 613. The cut trash T that has slid down on the slanting surface of the slope 601 is pinched sooner or later by the slope 601 and the belt 602. The belt 602 is a drive belt capable of being driven by the motor 611 and the gear column 612. The surface (conveyance surface) of the belt 602, which is on the side that comes into contact with the slope 601, moves in the belt conveyance direction C by the drive by the motor 611 and the gear train 612. In the case where the friction force acting between the cut trash T and the belt 602 is larger than the friction force acting between the cut trash T and the slope 601, the cut trash T is conveyed in the belt conveyance direction C. In other words, the cut trash T is not conveyed in the conveyance direction C until it falls to the contact part between the slope 601 and the conveyance surface of the belt 602. Due to this configuration, the position and posture at the time of the conveyance of the cut trash T in the case where the cut trash T is conveyed by the belt 602 are determined uniquely regardless of the position and posture at the time of fall.

FIG. 6C is a partial section diagram in the case where the cut trash discharge unit 600 is viewed from the upstream side (in the fall direction B) in the fall direction B, i.e., viewed from below toward above in the vertical direction, and the belt 602 is cut at the portion in the vicinity of the center. The belt 602 is in contact with the pinch belt 603 on the downstream side in the belt conveyance direction C. The belt 602 and the pinch belt 603 have a function as a pinch and conveyance system to discharge the cut trash T, which is conveyed through a space sandwiched between and formed by the slope 601 and the belt 602, to the outside of the space.

The two shafts that restrict the pinch belt 603 can rotate freely and the pinch belt 603 is a driven belt that is driven by the movement of the belt 602. The cut trash T that is conveyed in the belt conveyance direction C is pinched sooner or later by the belt 602 and the pinch belt 603 and is conveyed in the vertical posture (posture having an inclination with respect to a horizontal surface (inclination that intersects with a horizontal surface). The configuration is designed so that the distance between the belt 602 and the pinch belt 603 becomes greater toward the upstream side in the belt conveyance direction C and becomes smaller toward the downstream side as shown in FIG. 6C by appropriately arranging the two shafts that restrict the pinch belt 603. Due to this, the front end of the cut trash T in the belt conveyance direction C, i.e., the end part on the downstream side is guided by the pinch belt 603 and can securely thrust into the contact part between the conveyance surface of the belt 602 and the pinch belt 603.

The cut trash T that has been pinched and conveyed in the vertical posture having an inclination with respect to a horizontal surface next comes into contact with the guide 604 at its front end in the belt conveyance direction C, i.e., at the end part on the downstream side, and then, the cut trash T is guided into a position and a posture suitable to the trash box 605 by the guide 604. At this time, the cut trash T that has been pinched and conveyed in the vertical posture receives a force from the guide 604, which will deform the cut trash T in the thickness direction. The cut trash T tends to deform in the thickness direction most easily, and therefore, it is possible for the cut trash T to easily follow the guide 604. Further, the cut trash T that has been pinched and conveyed in the vertical posture is unlikely to cause a phenomenon in which the cut trash T droops due to the force of gravity even in the state of being pinched between the belt 602 and the pinch belt 603 and of being supported in a cantilevered manner. Due to this, the cut trash T can be guided by the guide 604 up to the vicinity of the rear end in the belt conveyance direction C, i.e., the end part on the upstream side. After the cut trash T reaches a position and assumes a posture suitable to the trash box 605 substantially as a whole, the rear end of the cut trash T in the belt conveyance direction C, i.e., the end part on the upstream side leaves the contact part between the conveyance surface of the belt 602 and the pinch belt 603. In this manner, the cut trash T is discharged from the space sandwiched between and formed by the slope 601 and the belt 602 to the outside of the space. The discharged cut trash T falls from the guide 604 into the trash box 605 in the position and posture suitable to the trash box 605. As a result, the cut trash T produced at the time of cutting is discharged stably and securely into the trash box 605 and is accumulated therein.

Second Embodiment

Figure 7A:
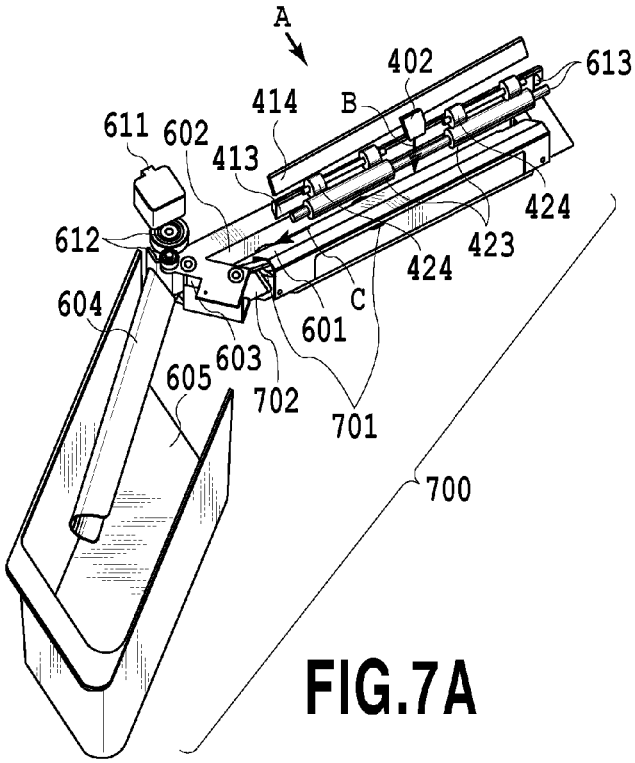
FIG. 7A is a perspective view of a driven roller-attached cut trash discharge unit according to the embodiment of the present invention.
Figure 7B:
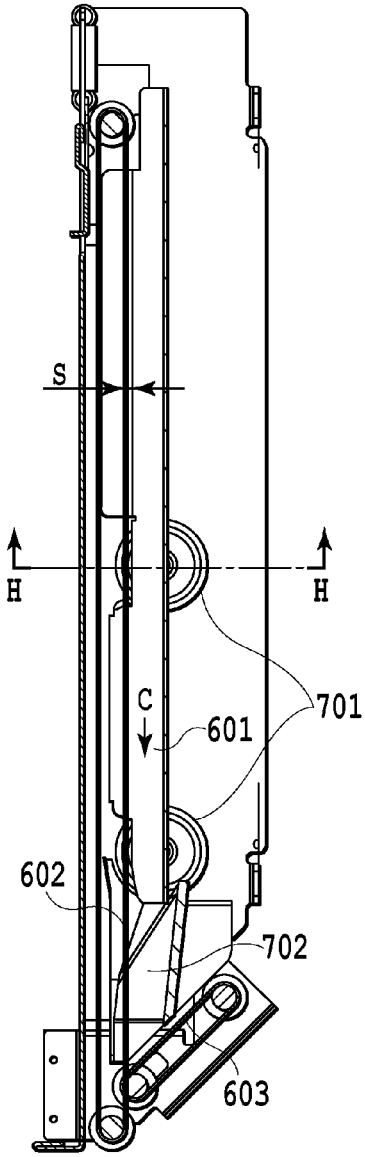
FIGS. 7B and 7C are section diagrams of the driven roller-attached cut trash discharge unit according to the embodiment of the present invention.
Figure 7C:
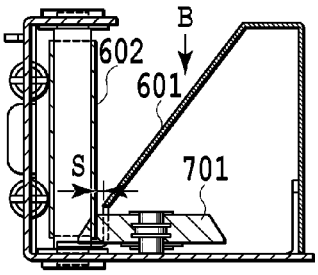
Figure 8:
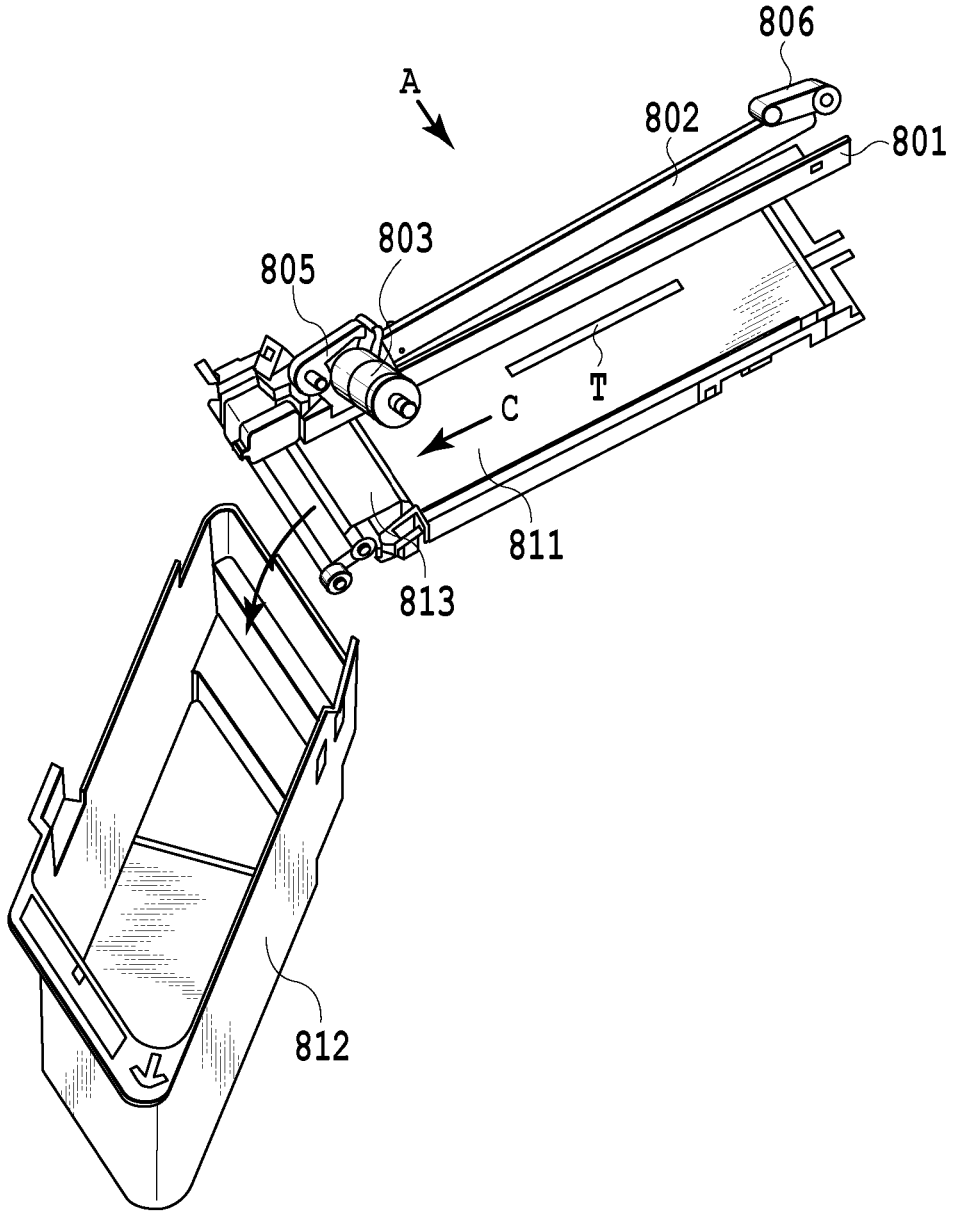
FIG. 8 is a schematic diagram showing a configuration of a prior art.

Next, as another embodiment that can improve the performance of the cut trash discharge unit, a driven roller-attached cut trash discharge unit 700 is explained in detail by using FIG. 7A, FIG. 7B, and FIG. 7C. The explanation of the same configuration as that of the first embodiment is omitted.

FIG. 7A is a perspective view of the whole of the driven roller-attached cut trash discharge unit 700. FIG. 7B is a section diagram in the case where the driven roller-attached cut trash discharge unit 700 is viewed from the upstream side (in the fall direction B) in the fall direction B, i.e., viewed from above toward below in the vertical direction and the portion in the vicinity of the trash box 605 is omitted. FIG. 7C is a section diagram in the case where the driven roller-attached cut trash discharge unit 700 is viewed from the downstream side in the belt conveyance direction C in the direction opposite to the belt conveyance direction C and is cut along an alternate long and short dash line H in FIG. 7B. The driven roller-attached cut trash discharge unit 700 has the configuration of the cut trash discharge unit 600 explained in FIGS. 6A to 6C, to which a driven roller 701 and a thrust-into guide 702 have been added and in which the shape of the slope 601 has been changed.

The driven roller 701 is a body of revolution having the shape of a cone whose upper portion has been truncated, in which the diameter becomes greater downward in the vertical direction. The driven roller 701 is arranged at the lower front end in the vertical direction of the slope 601 and is exposed slightly toward the side of the belt 602 from the cut trash slide-down surface (slanting surface) of the slope 601. Due to this, the belt 602 and the driven roller 701 are configured so as to be capable of coming into contact with each other. At this time, at least part of the side surface of the driven roller 701 comes into contact with the belt 602 and preferably, the at least part of the side surface forms a plane substantially flush with the cut trash slide-down surface (flush) of the slope 601.

The belt 602 is formed by a flexible material, such as rubber, and the shape of the belt 602 follows the shape of the slope 601 and the shape of the driven roller 701 exposed from the slope 601. The contact pressure between the driven roller 701 and the belt 602 is higher than the contact pressure between the slope 601 and the belt 602. The driven roller 701 is supported rotatably and rotates in accordance with the movement of the belt 602 by the drive of the belt 602. The belt 602 and the contact surface of the driven roller 701 each have a function as a conveyance surface that conveys the cut trash T pinched therebetween and a function of a driven surface. The cut trash T that has been cut off by the second cutting and has slid down on the slanting surface of the slope 601 will be sooner or later pinched between the belt 602 and the driven roller 701. The cut trash T pinched between the belt 602 and the driven roller 701 is conveyed in the belt conveyance direction C by the drive of the belt 602 in accordance with the movement of the belt 602.

Here, in the present embodiment, as shown in FIG. 7B and FIG. 7C, the lower front end in the vertical direction of the slope 601 and the belt 602 are configured so as to be spaced by a slit S on the upstream side in the belt conveyance direction C. In the range of the slit S, the slope 601 and the belt 602 do not pinch the cut trash T. Consequently, even in the case where one end of the cut trash T whose posture is not fixed due to the impact of the second cutting falls in the range of the slit S, the posture of the cut trash T is not kept because the slope 601 and the belt 602 do not pinch the cut trash T, and therefore, the cut trash T will lie down sooner or later due to the force of gravity. The cut trash T securely lies down at the contact part between the driven roller 701 and the belt 602 and is conveyed in the belt conveyance direction C.

As shown in FIG. 7B, on the downstream side in the belt conveyance direction C, the thrust-into guide 702 is provided. In order to expose the driven roller 701 from the cut trash slide-down surface, the slope 601 has notches in several positions. The thrust-into guide 702 has the shape suitable to prevent the front end of the cut trash T from being hooked in the notch of the slope 601 or from entering the notch of the slope 601.

According to the present embodiment, as in the first embodiment, the cut trash T falls from the guide 604 into the trash box 605 in the position and posture suitable to the trash box 605. As a result, the cut trash T produced at the time of cutting is discharged into the trash box 605 stably and securely and then is accumulated therein.

Further, according to the present embodiment, the cut trash discharge unit includes the driven roller, and therefore, the effect of the following improvement in performance is obtained in addition to the same effect as that of the first embodiment. It is possible to convey the cut trash T in the belt conveyance direction C regardless of the magnitude of the friction force acting between the cut trash T and the belt 602 and that acting between the cut trash T and the slope 601, respectively. The belt 602 comes into contact mainly with the driven roller 701, not with the slop 601 that is not driven, and therefore, is hardly worn away. Further, the cut trash T is not conveyed in the belt conveyance direction C until the cut trash T is pinched between the driven roller 701, which is disposed at the lower part of the cut trash slide-down surface of the slope 601, and the belt 602. Due to this configuration, the position and posture of the cut trash T at the time of conveyance in the case where the cut trash T is conveyed by the belt 602 are determined uniquely regardless of the position and posture at the time of fall.

Other Embodiments

In the above-described embodiments, explanation is given on the assumption that the slope 601 is not driven by the movement of the belt 602, but the slope 601 may be driven by the movement of the belt 602. For example, at least part of the slope 601 may be formed by the driven belt and/or the driven roller. In such a configuration, it is possible to make the belt more resistant to wear.

In the second embodiment, the lower front end in the vertical direction of the slope 601 may be located lower in the vertical direction toward the upstream side in the belt conveyance direction. Further, the distance between the belt 602 and the slope 601 may become smaller toward the downstream side in the belt conveyance direction. Furthermore, the driven roller may be disposed on the downstream side of the center of the slop 601 in the belt conveyance direction. In these configurations, the position and posture at the time of conveyance in the case where the cut trash T is conveyed by the belt 602 are determined uniquely more easily regardless of the position and posture at the time of fall.

With the above in mind, according to the sheet conveyance apparatus, the sheet cutting apparatus, and the image forming apparatus including the sheet conveyance unit configured to convey a cut sheet according to the present invention, it is possible to stably and securely convey a medium in the form of a cut sheet. Further, it is possible to stably and securely discharge cut trash produced at the time of cutting, and therefore, it is possible to provide a printer free from jamming of cut trash and with a high productivity.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-039576 filed on Feb. 28, 2014 which is hereby incorporated by reference wherein in its entirety.

What is claimed is:

1. A sheet conveyance apparatus comprising a conveyance unit configured to convey a sheet, wherein the conveyance unit:

includes a slanting surface having an inclination with respect to a horizontal surface and a conveyance surface that forms, together with the slanting surface, a space that becomes narrower downward in the vertical direction and which moves in a predetermined direction; and conveys the sheet in the predetermined direction by the movement of the conveyance surface.

2. The sheet conveyance apparatus according to claim 1, wherein the conveyance surface is provided so as to extend in the vertical direction.

3. The sheet conveyance apparatus according to claim 1, wherein the conveyance unit pinches the sheet between the slanting surface and the conveyance surface and conveys the sheet in the predetermined direction.

4. The sheet conveyance apparatus according to claim 1, wherein the conveyance surface is formed by a drive belt capable of driving.

5. The sheet conveyance apparatus according to claim 1, wherein at least part of the slanting surface is formed by a driven belt that is driven by the conveyance surface.

6. The sheet conveyance apparatus according to claim 1, wherein at least part of the slanting surface is formed by a driven roller that is driven by the conveyance surface.

7. The sheet conveyance apparatus according to claim 1, wherein at least part of the slanting surface is formed by a slope and a driven roller, the driven roller is arranged at a lower part, in the vertical direction, of the slope, and the conveyance unit pinches the sheet between the slanting surface and the driven roller and conveys the sheet in the predetermined direction by the movement of the conveyance surface.

8. The sheet conveyance apparatus according to claim 7, wherein at least part, in the predetermined direction, of the slope has a notch that exposes the driven roller.

9. The sheet conveyance apparatus according to claim 1, wherein the space becomes narrower toward a downstream side in a conveyance direction of a sheet by the conveyance unit.

10. The sheet conveyance apparatus according to claim 1, wherein the slanting surface is made of a member whose coefficient of friction is kept low.

11. The sheet conveyance apparatus according to claim 1, further comprising a guide configured to guide a sheet that is conveyed by the conveyance unit to a discharge unit that is provided on a downstream side in a conveyance direction of the conveyance unit.

12. The sheet conveyance apparatus according to claim 1, wherein the sheet is trash after an image based on image data is cut off.

13. A cutting apparatus for cutting a sheet, the cutting apparatus comprising:

a cutting unit configured to cut a sheet; and a conveyance unit configured to convey a sheet cut by the cutting unit, wherein the conveyance unit includes a slanting surface having an inclination with respect to a horizontal surface and a conveyance surface that forms, together with the slanting surface, a space that becomes narrower downward in the vertical direction and which moves in a predetermined direction, and the conveyance unit conveys a sheet cut by the cutting unit in the predetermined direction by the movement of the conveyance surface.

14. An image forming apparatus for forming an image on a sheet, the image forming apparatus comprising:

an image forming unit configured to form an image on a sheet; and a conveyance unit configured to convey a sheet, wherein the conveyance unit includes a slanting surface having an inclination with respect to a horizontal surface and a conveyance surface that forms, together with the slanting surface, a space that becomes narrower downward in the vertical direction and which moves in a predetermined direction, and the conveyance unit conveys the sheet in the predetermined direction by the movement of the conveyance surface.

15. The sheet image forming apparatus according to claim 14, further comprising a cutting unit configured to cut a sheet on which an image has been formed by the image forming unit, wherein a sheet that the conveyance unit conveys is trash after an image formed by the image forming unit is cut off by the cutting unit.

* * * * *